United States Patent [19]

Reimer

[11] 4,222,400

[45] Sep. 16, 1980

[54] CAR TOP TENT

[76] Inventor: Paul Reimer, 29 McLoughlin St., Glen Cove, N.Y. 11542

[21] Appl. No.: 765,880

[22] Filed: Feb. 7, 1977

[51] Int. Cl.[2] ..... A45F 1/16

[52] U.S. Cl. ..... 135/1 A; 135/2; 135/3 A; 135/4 A

[58] Field of Search ..... 135/1 A, 1 D, 2, 3 A, 135/3 C, 4 A, 4 B; 296/23 MC; 224/42.1 E

[56] References Cited

U.S. PATENT DOCUMENTS

| | | | |
|---|---|---|---|
| 2,531,678 | 11/1950 | Gledhill | 296/23 MC |
| 3,703,181 | 11/1972 | Tholen | 135/3 A X |
| 3,874,397 | 4/1975 | Oberhaus | 135/2 |
| 4,033,366 | 7/1977 | Forget | 135/2 |

*Primary Examiner*—Werner H. Schroeder
*Assistant Examiner*—Conrad L. Berman
*Attorney, Agent, or Firm*—Charles J. Speciale

[57] ABSTRACT

A portable tent adapted to be mounted on the top of a vehicle having a rigid roof, with a pair of transversely extending supports thereon, with the portable tent comprising a rectangular support frame including a horizontal flange, a peripheral flange, and the support frame adapted for positionment across the supports, with a floor mounted within the support frame and extending on the horizontal flange for supporting the user of the tent. A flexible water repellent canopy is provided and includes a base and upwardly extending walls joined together, and having an opening along one of the walls to gain access to the canopy, with the base extending in overlapping relationship to the floor.

An upwardly extending collapsible frame is adapted to extend within the canopy in an assembled position supporting same during use thereof, and readily dis-assembled when not in use. The collapsible frame comprising a center support member permanently attached to the canopy centrally therein, having a removable center pole adapted to be releasably secured to the member and to extend to the floor for initially supporting the canopy when placing the frame in its assembled position, and a plurality of rods for supporting the walls of the canopy during use thereof. There also being provided securing means for releasably connecting each rod at one end thereof to the member for supporting the walls of the canopy.

10 Claims, 5 Drawing Figures

CAR TOP TENT

BACKGROUND OF THE INVENTION

1. Field of the Invention

The present invention relates to a car top tent that is easily assembled for use and thereafter folded and remaining upon the top of an automobile as a car top carrier.

2. Description of the Prior Art

The use of the top of an automobile for supporting a portable tent has been proposed in the prior art, as for example illustrated in U.S. Pat. No. 2,670,747. In contrast to the portable tent disclosed therein, the present inventor has found that a simplified construction is most suitable to accomplish the same end result. The structure of the car top tent of the present invention, as hereinafter explained in detail, will clearly illustrate that a simplified construction, which is more economical, can be incorporated for use on an automobile.

OBJECTS OF THE INVENTION

An object of the present invention is to provide a car top tent that is readily assembled into operative position for use.

Another object of the present invention is to provide a portable tent for mounting on a car top in which the canopy may be collapsed and remains in place while the automobile is in transit, and can be used as a car top carrier.

Other objects and advantages of the present invention will become apparent as the disclosure proceeds.

SUMMARY OF THE INVENTION

A portable tent adapted to be mounted on the top of a vehicle having a rigid roof, with a pair of transversely extending supports thereon, like conventional car top carrier bars, for boats etc. with the portable tent comprising a rectangular support including horizontal and vertical flanges, and the support frame adapted for positionment across the supports, with a floor mounted within the frame for supporting the user of the tent. A flexible water repellent canopy is provided and includes a base and upwardly extending walls joined together and having an opening along one of the walls to gain access to the canopy, with the base extending in overlapping relationship to the floor.

a plurality of upwardly extending removable flexible rods adapted to extend within the canopy and in an assembled position supporting same during use thereof as a frame, and readily disassembled when not in use, with the assembled frame comprising a center support member permanently attached to the canopy centrally therein. There being a removable center pole adapted to be releasably secured to the member and to extend to the floor for initially supporting the canopy when placing the rods in its assembled position, and a plurality of rods for supporting the walls of said canopy during use thereof. There also being provided securing means for releasably connecting each rod at one end thereof to the member for supporting the walls of the canopy.

Each rod has at the opposite end thereof a bumper, of plastic or rubber, adapted to engage the base of the canopy and positionable adjacent a wall of the canopy. The rain flap extending peripherally from the walls of the canopy adjacent the base, and the flap extending over the flange to prevent water from accumulating between the frame and the canopy onto the floor. Connecting means for tying down the canopy to the frame adjacent the base is also provided.

The connecting means includes a plurality of spaced apart hooks extending downwardly from the frame, with a plurality of straps extending from the walls of the canopy, and the spacing between the straps being substantially equal to the spacing between the hooks, such that each strap may be connected to a respective hook.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
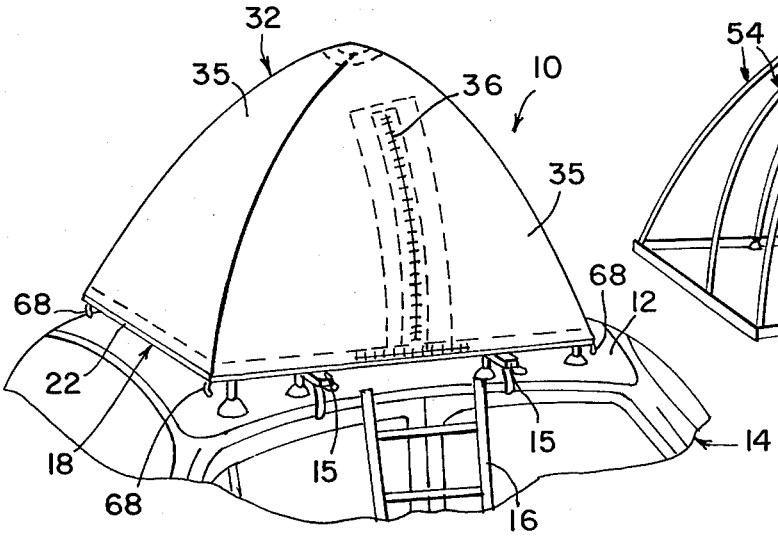
FIG. 1 is a perspective view of the portable tent in its open assembled position on a car top.

Referring to the drawings, there is illustrated in FIGS. 1 through 5 a portable tent 10 adapted to be mounted on the top 12 of an automobile or motor vehicle 14. The rigid roof 12 may have a pair, or more, of transversely extending supports 15 secured thereto in a conventional manner. A ladder 16 would normally be used to gain access to the tent 10.

Figure 3:
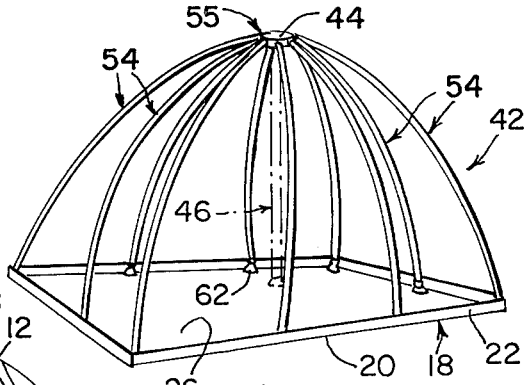
FIG. 3 is a perspective view illustrating the framework of the structure of the portable tent.
Figure 4:
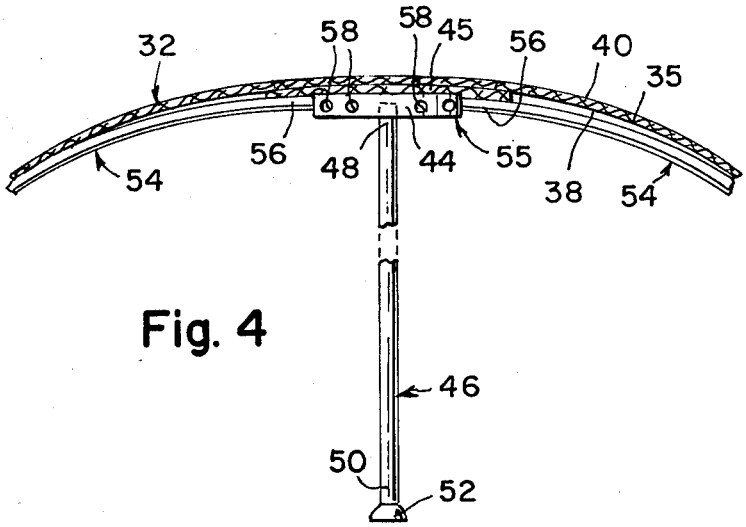
FIG. 4 is a fragmentary view illustrating the procedure for assembling the tent.

As particularly illustrated in FIGS. 3 and 4, a rectangular support frame 18 is utilized and may be fabricated from steel. The support frame 18 includes a horizontal flange 20 and a vertically extending peripheral flange 22 having an inner edge 24 and outer edge 25. The support frame 18 is adapted for positionment across the supports 15.

A floor 26 is mounted within the support frame 18 and includes an upper surface 28 and lower surface 30. The floor 26 may be fabricated from plywood for supporting the user of the tent thereon. The flanges 22 prevent lateral movement of the floor 26. The support frame 18 is attached to the supports 15 as by bolts (not shown).

Figure 5:
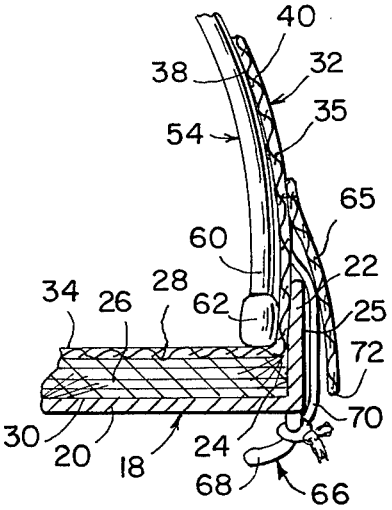
FIG. 5 is an enlarged fragmentary view illustrating the structure at the base of the tent.

A flexible water repellent canopy 32 forms the tent structure in the open position thereof. The canopy 32 includes a base 34 extending across the floor 26 on the upper surface 28 as illustrated in FIG. 5. The base 34 has four walls 35 extending upwardly therefrom. The walls 35 are joined together and have an opening 36 on one of the walls 35 to gain access to the canopy 32. A zipper or other fastener may be used at the entrance 36 to close it off when the user of the tent is inside thereof. Each wall 35 includes an inner surface 38 and outer surface 40. The material of the wall 35 may be provided in a variety of colors and materials.

One of the novel features of the present invention is that there is provided an upwardly extending collapsible frame 42 adapted to extend within the canopy 32 in an assembled position for supporting same during use thereof. The frame 42 is readily dis-assembled when not in use. The frame 42 includes a center support member 44 illustrated in FIG. 4 that may be in the form of a disc and is permanently attached to the canopy 32 by means of an additional piece of material 45. The member 44 is centrally coupled to the canopy 32.

To assist the user in assembling the tent, a removable center pole 46 is provided. The pole 46 is releasably secured at one end 48 to the member 44. The other end 50 of the pole 46 extends to the base 34. In this manner, by providing a bumper of rubber tip 52 at the lower end 50 of the pole 46, the tent 10 is initially propped up or supported. In this supported position a plurality of rods 54 may be positioned adjacent the inner surface 38 of the walls 35. Securing means 55 is provided for releasably connecting each rod 54 at its upper end 56 to the member 44. This may be accomplished by providing a plurality of radially extending apertures 58 adapted to receive the upper end 56 of each rod 54 therein.

Figure 2:
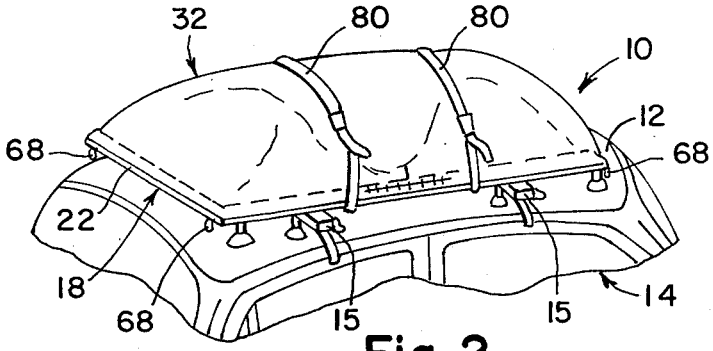
FIG. 2 is a perspective view similar to FIG. 1 illustrating the portable tent in its folded position.

Each rod 54 is adapted to have at the opposite end 60 a bumper 62 adapted to engage the base 34 of the canopy 32, and positionable adjacent a wall 35 thereof. Each bumper 62 may be made from a rubber material, or soft plastic, and extends adjacent the flanges 22. The rods 54 must be flexible to be bowed to the shape of the canopy 32. Once the canopy 32 is assembled and retained in position by the frame 42, the center pole 46 may be removed so as to provide the necessary room for sleeping for the user of the tent. The rods 54 are adapted to be stowed in the canopy 32 in the folded position thereof, as illustrated in FIG. 2.

To protect the floor 26, a rain flap 65 is provided that extends peripherally from the walls 35 of the canopy 32 adjacent the base 34. The flap 65 extends over the flange 22 to prevent water from accumulating between the frame 18 and the canopy 32.

To further support the canopy 32, connecting means 66 is provided for tying down the canopy 32 to the frame 18 adjacent the base 34. The connecting means 66 may include a plurality of spaced apart hooks 68 that extend around the frame. The hooks 68 are generally located at each corner of the frame 18. A plurality of straps 70 extend from the walls 35. The spacing between the straps 70 being substantially equal to the spacing between the hooks 68, such that each strap 70 may be connected to a respective hook 68. The straps 70 extend from the walls 35 below the rain flap 65. The terminal end 72 of the rain flap 65 is adjacent to the lower portion or bottom of the frame 18.

A pair of straps 80 may be provided for strapping the canopy 32 in the folded position thereof to the frame 18. The rods 54 to be made from solid fiberglass, preferably.

Accordingly, the above described portable tent is readily assembled with a minimum amount of effort on the part of the user and thereafter readily disassembled and used as a car top carrier for storge. The tent is also economical to manufacture.

Although an illustrative embodiment of the invention has been described in detail herein with reference to the accompanying drawings, it is to be understood that the invention is not limited to the precise embodiment and that various changes and modifications may be effected therein without departing from the scope or spirit of the invention.

I claim:

1. A portable tent adapted to be mounted on the top of a vehicle having a rigid roof, with a pair of transversely extending supports thereon said portable tent comprising a. a rectangular support frame including a flange, and said frame adapted for positionment across the supports, b. a floor mounted within said support frame for supporting the user of said tent, c. a flexible water repellent canopy including a base and upwardly extending walls joined together, and having an opening along one of said walls to gain access to said canopy, said base extending in overlapping relationship to said floor, d. a plurality of extending removable flexible rods adapted to extend within said canopy and in an assembled position supporting same during use thereof; as a frame and readily dis-assembled when not in use; said assembled frame comprising (1) a center support member permanently attached to said canopy centrally therein, (2) a removable center pole adapted to be releasably secured to said member, and to extend to said floor for initially supporting said canopy when placing said removable rods in its assembled position, and removed after that (center pole), (3) a plurality of rods for supporting said walls of said canopy during use thereof, (4) securing means for releasably connecting each said rod at one end thereof to said member for supporting said walls of said canopy, (5) each said rod having at the opposite end thereof a bumper adapted to engage said base of said canopy and positionable adjacent a wall of said canopy, e. a rain flap extending peripherally from said walls of said canopy adjacent said base, said flap extending over said flange to prevent water from accumulating between said frame and said canopy onto said floor, and f. connecting means for tying down said canopy to said frame adjacent said base.

2. A portable tent as in claim 1, wherein said connecting means includes:

a. a plurality of spaced apart hooks extending downwardly from said support frame, b. a plurality of straps extending from said walls of said canopy, said spacing between said straps being substantially equal to said spacing between said hooks, such that each strap may be connected to a respective hook.

3. A portable tent as in claim 2, said straps extending from said walls below said rain flap.

4. A portable tent as in claim 1, wherein said rods are flexible to be bowed to the shape of said canopy.

5. A portable tent as in claim 1, wherein said rods are adapted to be stowed in said canopy in the folded position thereof.

6. A portable tent as in claim 1, wherein said bumper is of a rubber or plastic material on each said rod.

7. A portable tent as in claim 1, wherein said rods are fabricated from fiberglass.

8. A portable tent as in claim 1, wherein said support frame includes a horizontal flange extending inwardly of said flange which extends vertically, said floor mounted on said horizontal flange.

9. A portable tent as in claim 1, wherein said securing means includes a plurality of apertures extending radially within said member and adapted to receive one end of each said rod in each of said apertures.

10. A portable tent as in claim 1, and including a pair of straps for strapping said canopy in the folded position thereof to said frame while using it as a car top carrier.

* * * * *